US005947088A

United States Patent [19]

DeGroot et al.

[11] Patent Number: 5,947,088

[45] Date of Patent: Sep. 7, 1999

[54] ACCELERATION ENRICHMENT BASED ON A FUEL MODIFIER

[75] Inventors: Kenneth P. DeGroot, Macomb Township; Michael J. Reale, Royal Oak; Bruce H. Teague, Grosse Pointe Park; Raymond J. Sullivan, Royal Oak; Dennis A. Soltis, Lake Orion, all of Mich.

[73] Assignee: Chrysler Corporation, Auburn Hills, Mich.

[21] Appl. No.: 09/144,028

[22] Filed: Aug. 31, 1998

[51] Int. Cl.[6] ..... F02D 41/10

[52] U.S. Cl. ..... 123/436; 123/486; 123/492

[58] Field of Search ..... 123/486, 436, 123/492, 32

[56] References Cited

U.S. PATENT DOCUMENTS

| | | | |
|---|---|---|---|
| 3,926,153 | 12/1975 | Reddy | 123/32 |
| 5,003,944 | 4/1991 | Moote et al. | 123/299 |
| 5,113,827 | 5/1992 | Vincent | 123/417 |
| 5,335,637 | 8/1994 | Davis et al. | 123/478 |
| 5,435,285 | 7/1995 | Adams et al. | 123/492 |
| 5,544,640 | 8/1996 | Thomas et al. | 123/689 |
| 5,596,975 | 1/1997 | Thomas et al. | 123/686 |
| 5,634,868 | 6/1997 | Weber et al. | 477/107 |
| 5,809,969 | 9/1998 | Fiaschetti et al. | 123/436 |

*Primary Examiner*—Tony M. Argenbright
*Assistant Examiner*—Mahmoud M. Gimie
*Attorney, Agent, or Firm*—Mark P. Calcaterra

[57] ABSTRACT

A method is provided for enriching a fuel to air ratio in an engine during acceleration based on a known fuel multiplier. Initially, the method retrieves the fuel multiplier from a dynamic crankshaft fuel control (DCFC) system. This system uses the fuel multiplier to reduce the amount of fuel delivered to the engine. When acceleration is desired, the method increases the overall acceleration enrichment values as a function of the DCFC fuel multiplier. Thus, when the vehicle is launched via a throttle tip-in while the DCFC system is active, the acceleration enrichment values are increased thereby improving drivability by having combustion taking place in a richer environment.

7 Claims, 1 Drawing Sheet

ACCELERATION ENRICHMENT BASED ON A FUEL MODIFIER

BACKGROUND OF THE INVENTION

1. Technical Field

The present invention generally relates to engine control systems for automotive vehicles and, more particularly, to a method of improving drivability during acceleration based on a fuel multiplier.

2. Discussion

Recent advances in automotive vehicle engine control systems have led to the development of dynamic crankshaft fueling control systems. For instance, commonly assigned U.S. patent application Ser. No. 08/901,859, entitled "Method for Processing Crankshaft Speed Fluctuations for Control Applications" filed Jul. 29, 1997, now U.S. Pat. No. 5,809,969, which is hereby expressly incorporated by reference herein, discloses one such dynamic fueling control system. According to this system, the amount of fuel delivered to the engine is reduced to obtain superior catalyst light off and engine out hydrocarbon reduction. However, if acceleration is demanded while the dynamic fueling control system is active, the typical amount of acceleration enrichment applied during throttle tip-in is insufficient to achieve optimum engine performance. Thus, with the standard acceleration enrichment, a lean tip-in sag condition exists while the dynamic fueling control system is active. From a calibration stand-point, this trend is particularly noticeable when 1300 drivability index fuel is used.

In view of the foregoing, it would be desirable to provide a system for enhancing the level of acceleration enrichment applied during a throttle tip-in event when an associated dynamic crankshaft fuel control system is active.

SUMMARY OF THE INVENTION

The above and other objects are provided by a system for providing acceleration enrichment based on a known fuel multiplier. Initially, the methodology of the present invention retrieves the fuel multiplier from a known dynamic crankshaft fuel control (DCFC) system. This fuel multiplier is being used by the DCFC system to adjust the pulse width delivered to the fuel injectors thereby reducing the amount of fuel delivered to the engine. This causes leaner than normal operation to take place. In response, the methodology increases the overall acceleration enrichment values as a function of the DCFC multiplier. Thus, when the vehicle is launched via a throttle tip-in, the acceleration enrichment values are increased to improve drivability. As a further feature of the present invention, the acceleration enrichments are only a small component and a short-lived event in the throttle tip-in sequence and the overall fuel multiplier remains intact for remaining engine operation.

BRIEF DESCRIPTION OF THE DRAWING

In order to appreciate the manner in which the advantages and objects of the invention are obtained, a more particular description of the invention will be rendered by reference to specific embodiments thereof which are illustrated in the appended drawing. Understanding that this drawing only depicts a preferred embodiment of the present invention and is not therefore to be considered limiting in scope, the invention will be described and explained with additional specificity and detail through the use of the accompanying drawing in which.

DETAILED DESCRIPTION OF THE PREFERRED EMBODIMENTS

Figure 1:
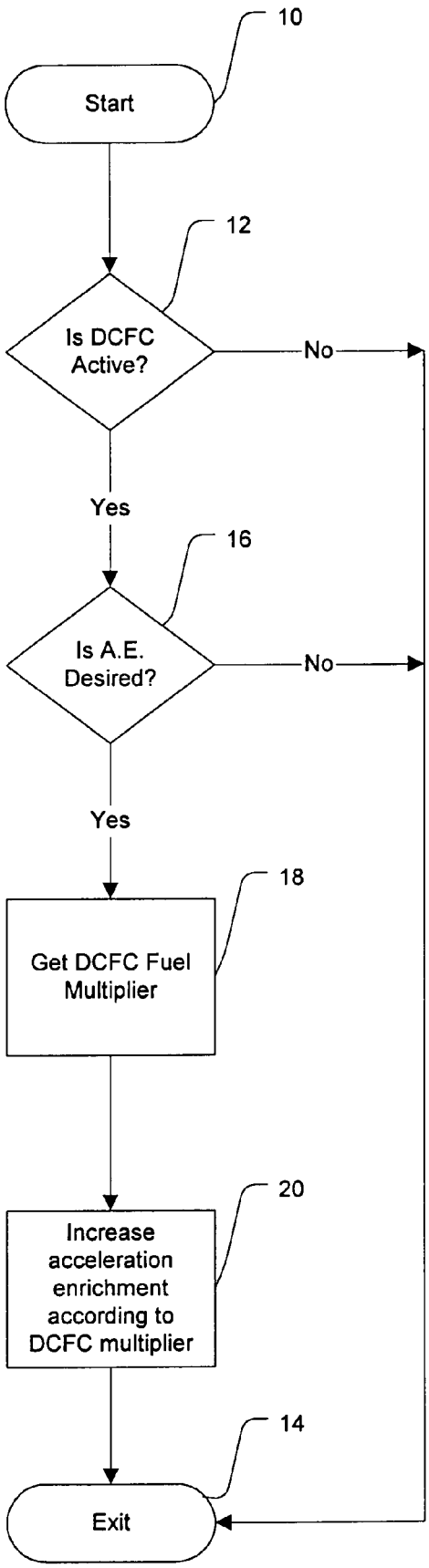
FIG. 1 is a flow chart depicting a method of improving drivability during acceleration through enrichment based on a fuel multiplier according to the present invention.

The present invention is directed towards a method of improving drivability during acceleration in a vehicle equipped with a dynamic crankshaft fuel control (DCFC) system. More particularly, an acceleration enrichment value for the engine is adjusted based on a fuel multiplier from the DCFC system. As such, drivability during acceleration is improved since combustion takes place in a richer environment.

Turning now to FIG. 1, the methodology starts at bubble 10 and falls through to decision block 12. In decision block 12 the methodology determines if the vehicle's DCFC system is active. If not, the methodology advances to bubble 14 and exits the routine pending a subsequent execution thereof. However, if the DCFC system is active at decision block 12 the methodology continues to decision block 16.

In decision block 16, the methodology determines if throttle or manifold absolute pressure (MAP) acceleration enrichment is desired. Such acceleration enrichment would be desired, for example, during the transient throttle tip-in sequence. If no throttle or MAP acceleration enrichment is desired at decision block 16 the methodology advances to bubble 14 and exits the routine. However, if throttle or MAP acceleration enrichment is desired at decision block 16, the methodology advances to block 18.

In block 18, the methodology retrieves the DCFC fuel multiplier from a memory location of the DCFC system, such as the engine control unit. From block 18 the methodology advances to block 20 and increases the acceleration enrichment value according to the DCFC fuel multiplier. For example, a look-up table could be utilized for this purpose such as:

| DCFC Fuel Multiplier | Acceleration Enrichment Multiplier |
|---|---|
| −10% | +10% |
| −20% | +20% |
| −25% | +25% |

From block 20, the methodology continues to bubble 14 where it exits the routine. It should be noted that the execution of the routine is run frequently such that the acceleration enrichment is removed after the throttle tip-in event so that the overall fuel multiplier remains intact for overall engine operation.

Thus, the present invention controls acceleration enrichment based on a fuel multiplier from a known DCFC system. When a vehicle is launched via the throttle tip-in, acceleration enrichment values are increased based on the DCFC multiplier. Accordingly, drivability is improved since combustion takes place in a richer environment.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A method of improving the drivability of a vehicle equipped with a dynamic crankshaft fuel control system during accelerations comprising:

determining if said dynamic crankshaft fuel control system is active;

determining if an acceleration enrichment is desired if said dynamic crankshaft fuel control system is active;

obtaining a fuel multiplier from said dynamic crankshaft fuel control system if said acceleration enrichment is desired; and increasing an acceleration enrichment setting of an engine in said vehicle according to said fuel multiplier.

2. The method of claim 1 wherein said acceleration enrichment setting is acquired from a look-up table.

3. The method of claim 1 wherein said step of determining if an acceleration enrichment is desired is based on throttle position.

4. The method of claim 1 wherein said step of determining if an acceleration enrichment is desired is based on a manifold absolute pressure.

5. A method of improving the drivability of a vehicle equipped with a dynamic crankshaft fuel control system during acceleration through the use of fuel enrichment comprising:

determining if said dynamic crankshaft fuel control system is active;

determining if an acceleration enrichment is desired if said dynamic crankshaft fuel control system is active;

obtaining a fuel multiplier from said dynamic crankshaft fuel control system if said acceleration enrichment is desired;

looking up an acceleration enrichment value corresponding to said fuel multiplier; and adjusting a fuel to air ratio of an engine of said vehicle according to said acceleration enrichment value.

6. The method of claim 5 wherein said step of determining if an acceleration enrichment is desired is based on throttle position.

7. The method of claim 5 wherein said step of determining if an acceleration enrichment is desired is based on manifold absolute pressure.

* * * * *